United States Patent [19]

Maeshima

[11] Patent Number: 4,688,269

[45] Date of Patent: Aug. 25, 1987

[54] PROTECTOR FOR SPORTSWEAR

[75] Inventor: Seiichi Maeshima, Osaka, Japan

[73] Assignee: Descente, Ltd., Osaka, Japan

[21] Appl. No.: 890,239

[22] Filed: Jul. 29, 1986

[51] Int. Cl.[4] ..... A41D 13/06; A41D 13/08

[52] U.S. Cl. ..... 2/2; 2/16; 2/22; 2/24

[58] Field of Search ..... 2/16, 22, 23, 24, 2, 2/2.5

[56] References Cited

U.S. PATENT DOCUMENTS 3,772,704 11/1973 Carbonneau ..... 2/22

3,991,420 11/1976 Savarino ..... 2/16

4,317,237 3/1982 Porte ..... 2/2

4,580,297 4/1986 MaeJima ..... 2/22

4,599,747 7/1986 Robinson ..... 2/16

*Primary Examiner*—Louis K. Rimrodt

*Attorney, Agent, or Firm*—Schwartz & Weinrieb

[57] ABSTRACT

In sportswear for use in a variety of sports games or competition such as skiing, riding, motorbiking and the like, this invention relates to a protector for sportswear which has the function of protecting a wearer's body as a result of being attached to a location which tends to collide with the obstacle.

15 Claims, 7 Drawing Figures

PROTECTOR FOR SPORTSWEAR

FIELD OF THE INVENTION

This invention relates to protectors for sportswear, and more particularly to protectors for sportswear which are used in various sportswear such as ski wear, or riding wear and the like, and having the function of protecting the wearer's body as a result of being attached to locations which tend to collide with obstacles.

BACKGROUND OF THE INVENTION

Heretofore, apparel for sports of vigorous or active physical exercises have been developed and used as shown in FIG. 6 in which pads 51 made of materials such as hard rubber and the like are attached to the front of the femoral region, knee region, leg region, elbow region and the front of the upper arm of the sportswear 50, and such sportswear act as sufficient buffers for protective functions.

However, in games or competitive sports in recent years, the speed of the exercise has become much faster, more vigorous and more active. The layout of pads 51 are placed on the essential parts of the sportswear 50 however, such have proven insufficient buffers for their protective functions. Normally the shocks undergone by the body when colliding with other obstacles are usually extremely large, resulting in the frequent occurrence of injurious accidents such as broken bones and the like. The pads 51 and the sportswear 50 themselves are not damaged by the collisions, unlike previous products which were problematic in this respect.

In view of this constraint, efforts to develop protectors for sportswear with effective buffer protective functions have been made for sports or competitive games. Tests have been conducted for their use at different speeds, but materials having the required degree of shock-absorption are not easily sewn into flexible sportswear. Usually when the sportsman wears such rigid clothing, it is uncomfortable and severely restrains movement, making such sportswear impractical.

OBJECT OF THE INVENTION

This invention has been made in view of the foregoing problems, and its object is to provide protectors for sportswear which are attached to locations of the body which tend to collide with obstacles in order positively to protect the wearer's body from accidents. This eliminates damage of the pads and the sportswear for sports or competitive games accompanied by vigorous or active exercises such as skiing, riding, motorbiking and the like.

SUMMARY OF THE INVENTION

The protector for sportwear of this invention is that the protector is made of hard cover plates similar to hard plastic plates covering the front portions of desired pads. For example the femoral front pad, knee pad, leg pad, elbow pad and the upper arm front pad are placed at the desired positions such as the femoral front region, knee region, leg region, elbow region and the upper arm front region. It is fixed to the sportswear either directly or indirectly. Accordingly, the structure for attaching the protector may be an exclusive structure independent of the pad or may be a member which also functions as a part of the pad.

BRIEF DESCRIPTION OF THE DRAWING

Various other objects, features, and attendant advantages of the present invention will become more fully apparent as the same becomes better understood when consideration in conjunction with the accompanying drawings, in which.

DETAILED DESCRIPTION OF THE INVENTION

The protector for sportswear according to this invention is constructed in such a way that the front of various pads such as the femoral front pad, knee pad, leg pad, elbow pad, the upper arm front pad and the like placed at essential portions of the sportswear are covered with hard cover plates. Such plates are fixed to the sportswear interchangeably by means of an elastic supporting structure, so that pads are interposed between the hard cover plates and the wearer's body. Accordingly, when a sportsman wearing a protector for sports has a collision accident with an obstacle during its use, the obstacle and the hard cover plate come into contact in the first place causing the hard cover plate to absorb the frictional forces in the surface direction. The wearer's body is protected by the surface thickness of the pad, which effectively absorbs the shock of the collision. Also, when the pad is made in such a way that it does not hinder the flexibility of the sportsman, both comfortability and mobility can be maintained. At the same time when the wearer collides with the obstacle, the pad of the colliding portion and the sportswear are protected by the hard cover plate to prevent them both from damage. Also, even when the hard cover plate is broken, it can be interchanged and replaced by attaching a new hard cover plate structure to the sportswear.

EMBODIMENT

Figure 1:
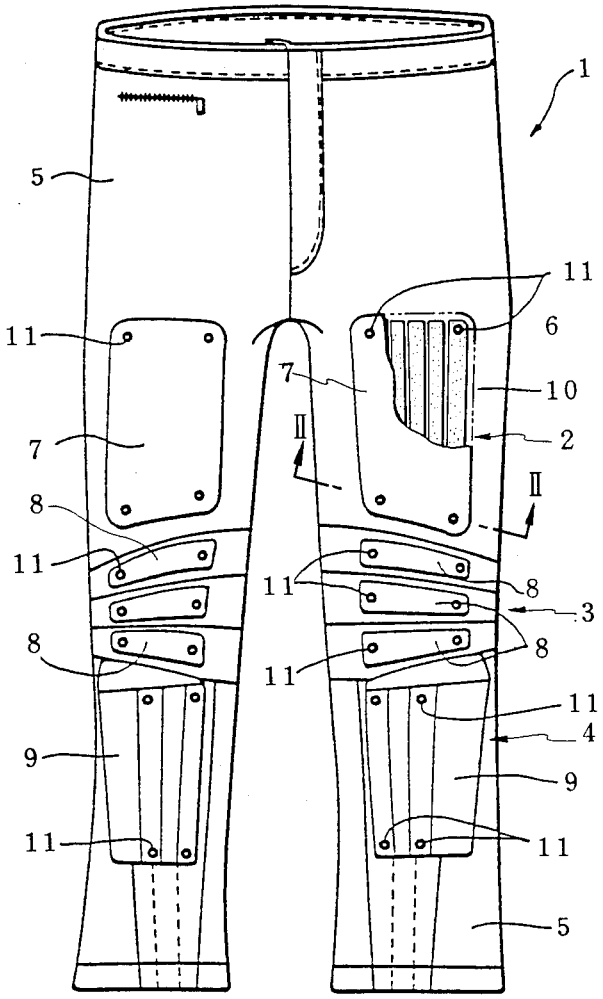
FIGS. 1 and 7 are elevation of a skipants and a ski jacket, respectively, which is cut-away showing an embodiment of a protector for sportswear of this invention.
Figure 2:
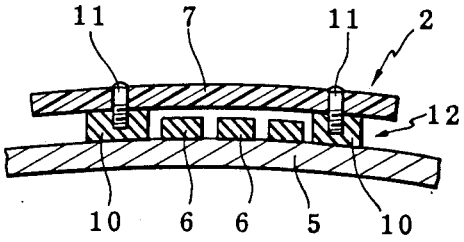
FIG. 2 is an enlarged cross section taken along a line II—II in FIG. 1.

An embodiment of the protector for sportswear according to this invention will be described by referring to the attached drawings in which FIG. 1 and FIG. 2 show skipants illustrating a first embodiment. The femoral front, knee region, and leg region of skipants 1, knee protector 3, and leg protector 4 are formed by covering the front surface of a pad 6 with the hard cover plate 7 for the femoral front region, hard cover plate 8 for the knee region, hard cover plate 9 for the leg region, the pad 6 being so as to be fixed to the surface of the sportswear material 5 having elasticity by bonding or fusing, and each of the hard cover plates 7, 8, 9 is formed from a hard plastic having excellent shockproof characteristics. For example, it can be formed by composite materials reinforced with, for example, glass fiber, carbon fiber and the like in addition to polycarbonate, ABS, polyester, polyamide and the like. Also, each pad 6 can be preferably formed from an elastic material such as rubber and the like, and in each part, its structure is such that each part is separated by a predetermined small gap in the surface direction and thus flexibility of the sportswear material 5 is maintained.

Each of the hard cover plates 7, 8, 9 is fixed to the sportswear 5 by means of an elastic supporting structure 12 in which support pads 10 bonded or fused to the sportswear material 5 are provided between the states and the sportswear by screws 11 inserted from the hard cover plate side into threaded blind holes formed within the support pads 10, the pad 10 being made of an elastic material of the same quality as the support pad 6 but of a heavier thickness than that of the pad 6 Each of the hard cover plates 7, 8, 9 interposed between the support pads 10 thus constitutes a floating structure having a gap between the under surface thereof and the pad 6. Also, the hard cover plates 7, 8, 9 can be interchanged with other hard cover plates by loosening the mounting screws 11 of the elastic supporting structure 12.

The hard cover plate 7 for the femoral front region and the hard cover plate 9 for the knee region of the femoral front protector 2 and the knee region protector 4 respectively can form the an integral construction covering the region, but the hard cover plate 8 of the knee region protector 3 is preferably formed of several structures in a laterally expanding direction so as not to interfere with the freedom of the skipants 1.

The sportswear protector having the foregoing construction is constructed in such a way that the pad 6 and the support pad 10 are interposed between the hard cover plates 7, 8, 9 and the wearer's body when a person puts the sportswear on. Accordingly, during its use, when each of the femoral front protector 2, knee region protector 3, and leg region protector 4 comes into contact with an obstacle, the friction in the surface direction is initially absorbed as a result of the contact with the hard coated plates 7, 8, 9. Accordingly, the wearer's body collides with the under surfaces of the femoral front pad hard cover plates 7, 8, 9 generally in the surface direction by means of the pad 6 and the support pad 10, producing a buffer action effectively absorbing the shock of the collision. Since the hard cover plates 7, 8, 9 perform the protection, and there is no direct contact of the pad 6 on the region and the sportswear material 5 with the obstacle as a result of the collision, breakage of the pad 6 or damage to the sportswear material 5 can be prevented. Furthermore, even in the case that the hard cover plates 7, 8, 9 are broken, the hard cover plates 7, 8, 9 can be interchanged by the elastic supporting structure 12.

Figure 3:
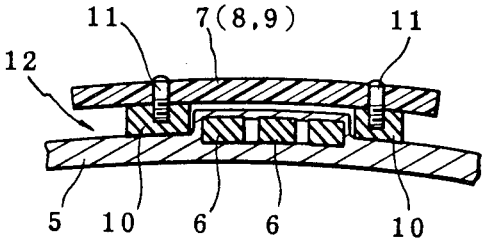
FIG. 3 through FIG. 5 are cross sections of the enlarged portions showing another embodiment of this invention.

Next, FIG. 3 shows a second embodiment of this invention in which pad 6 is embedded within the upper surface layers of the sportswear material 5.

Figure 4:
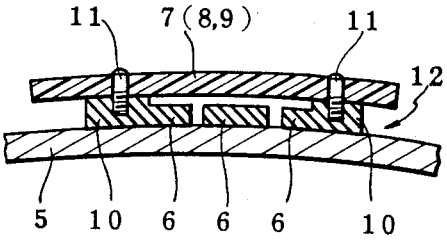

FIG. 4 shows a third embodiment of this invention in which the support pad 10 is integrally formed with the divided outside pad 6.

Figure 5:
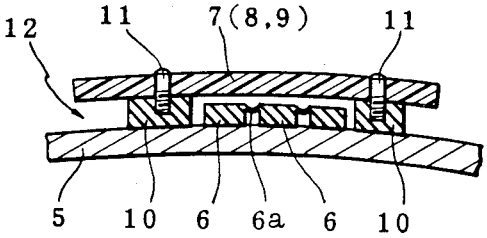
Figure 6:
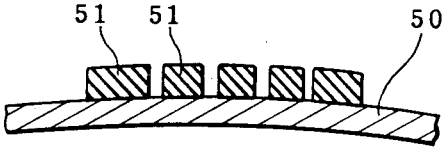
FIG. 6 (PRIOR ART)
FIG. 6 is a cross section of an enlarged portion showing a conventional protector.

FIG. 5 shows a fourth embodiment of this invention and showing a construction in which each divided pad 6, 6, 6 . . . is connected so as to form an integral unit by means of a slender connecting portion 6*a*.

Figure 7:
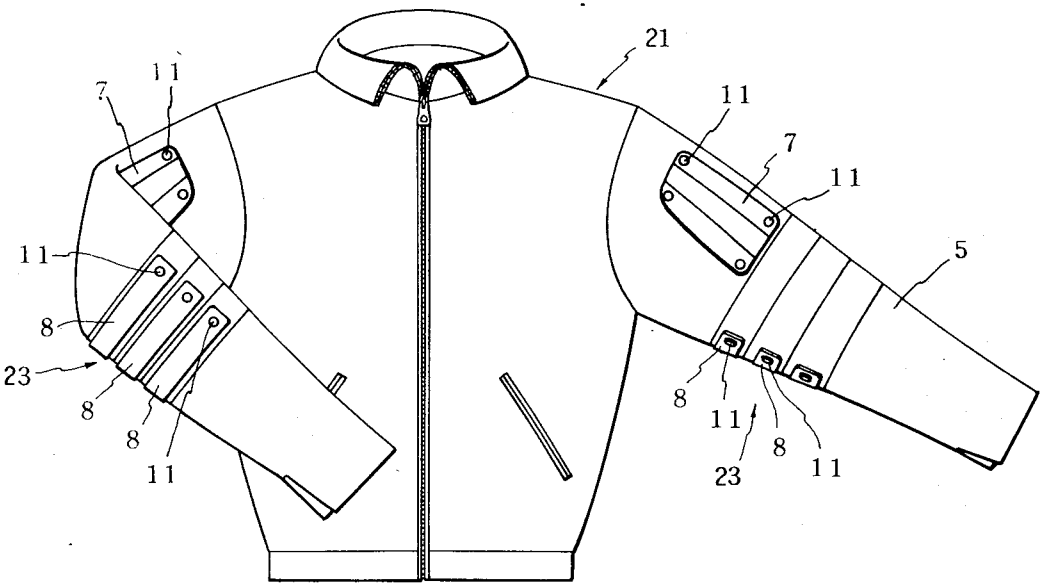

By the way, the foregoing embodiments are related to the skipants but in respect of all ski wear, this invention can be applied to the elbow region protector and the upper arm front protector of, for example, a ski jacket 21 as illustrated in FIG. 7. The elbow and upper arm protectors 23 include the same components as those described in connection with the skipants of FIG. 1, so consequently, further detailed description is deemed unnecessary. It can also be easily interchanged and put into practice with other sportswear used in a variety of games and competitions.

As described in the foregoing, the protector for sportswear of this invention can protect the wearer's body positively by absorbing strong shocks. When collision occurs this has a special effect of limiting the accident, and can also prevent damage to the sportswear material and the pads. In addition, since the hard cover plate is attached to the sportswear in a floating structure, the comfortable feeling does not deteriorate as a result of the rigidness and damage to the sportswear material. Even in instances of heavy sports usage, strenuous activites can be continued since the hard cover plate is a rigid material made of hard plastic.

Moreover, the protector for sportswear of this invention is constructed in such a way that it is made of a hard cover plate which is detachable by means of the elastic supporting structure. Since its detachment is extremely simple, it can easily be removed from the sportswear for cleaning or storing. Also in case the hard cover plate is broken, it can be easily interchanged. These are valuable features of this invention, which make it extemely practical.

Obviously, many modifications and variations of the present invention are possible in light of the above teachings. It is therefore to be understood that within the scope of the appended claims, the present invention may be practiced otherwise than as specifically described herein.

What is claimed is:

1. A protection system for use in combination with sportswear apparel, comprising:

a section of said sportswear apparel upon which said protection system is to be employed;

at least one shock-absorbing pad fixedly secured to the external surface of said section of said sportswear apparel for providing shock absorbing properties to a portion of the anatomy of the wearer of said apparel;

at least one hard cover plate disposed externally of said at least one shock-absorbing pad so as to cover and protect said at least one shock-absorbing pad; and means for mounting said at least one hard cover plate upon said sportswear apparel such that said at least one hard cover plate is spatially separated from said at least one shock-absorbing pad whereby a floating shock-absorbing system is defined between said at least one hard cover plate and said least one shock-absorbing pad.

2. A system as set forth in claim 1, wherein:

said at least one hard cover plate is fabricated from a hard plastic material.

3. A system as set forth in claim 1, wherein:

said at least one shock-absorbing pad is fabricated from rubber.

4. A system as set forth in claim 1, wherein:

said mounting means is fabricated from rubber.

5. A system as set forth in claim 1, further comprising:

means for detachably mounting said at least one hard cover plate upon said mounting means spatially separating said at least one hard cover plate from said at least one shock-absorbing pad.

6. A system as set forth in claim 5, wherein:

said means for detachably mounting said at least one hard cover plate upon said mounting means comprises bolt fasteners.

7. A system as set forth in claim 1, wherein:

said at least one shock-absorbing pad comprises a plurality of shock-absorbing pads spatially separated from each other in the lateral direction along the external surface of said wearing apparel.

8. A system as set forth in claim 7, wherein:

said plurality of shock-absorbing pads are integrally connected together by means of slender connecting portions.

9. A system as set forth in claim 7, wherein:

said mounting means spatially separating said at least one hard cover plate from said at least one shock-absorbing pad is integrally connected with another one of said shock-absorbing pads.

10. A system as set forth in claim 1, wherein:

said at least one shock-absorbing paid is embedded within said section of said sportswear apparel.

11. A system as set forth in claim 1, wherein:

said section of said sportswear apparel to which said protection system is applied is the femoral front region of said apparel for protecting the femoral front portion of said anatomy.

12. A system as set forth in claim 1, wherein:

said section of said sportswear apparel to which said protection system is applied is the knee region of said apparel for protecting the knee portion of said anatomy.

13. A system as set forth in claim 1, wherein:

said section of said sportswear apparel to which said protection system is applied is the leg region of said apparel for protecting the leg portion of said anatomy.

14. A system as set forth in claim 1, wherein:

said section of said sportswear apparel to which said protection system is applied is the elbow region of said apparel for protecting the elbow portion of said anatomy.

15. A system as set forth in claim 1, wherein:

said section of said sportswear apparel to which said protection system is applied is the upper arm region of said apparel for protecting the upper arm portion of said anatomy.

* * * * *